US005257514A

United States Patent [19]

Okuno

[11] Patent Number: 5,257,514

[45] Date of Patent: Nov. 2, 1993

[54] CONNECTIVE KNITTING METHOD OF TAPE-SHAPED KNIT END AND TAPE-SHAPED KNIT FABRIC HAVING AN END PART LINKED IN A KNIT STATE

[75] Inventor: Masao Okuno, Wakayama, Japan

[73] Assignee: Shima Seiki Mfg., Ltd., Wakayama, Japan

[21] Appl. No.: 675,198

[22] Filed: Mar. 26, 1991

[30] Foreign Application Priority Data

Mar. 28, 1990 [JP] Japan ..... 2-82590

[51] Int. Cl.[5] ..... D04B 27/00

[52] U.S. Cl. ..... 66/64; 66/172 R; 66/176

[58] Field of Search ..... 66/172 R, 171, 176, 66/189, 198, 174, 64

[56] References Cited

U.S. PATENT DOCUMENTS 3,668,901 6/1972 Betts et al. ..... 66/176
3,824,810 7/1974 Betts et al. ..... 66/189 X
4,048,819 9/1977 Johnson ..... 66/176 X
4,087,991 5/1978 Robinson et al. ..... 66/172 R X
4,111,009 9/1978 Robinson et al. ..... 66/172 R X
4,548,057 10/1985 Essig ..... 66/172 R

*Primary Examiner*—Clifford D. Crowder
*Assistant Examiner*—John J. Calvert
*Attorney, Agent, or Firm*—Edwin E. Greigg; Ronald E. Greigg

[57] ABSTRACT

The present invention presents a connective knitting method of tape-shaped knit ends capable of joining the end portions nearly simultaneously when knitting a tape or rope and a tape-shaped knit fabric having the end portions linked in a knit state, which comprises two pieces of tape-shaped knit fabric knitted by an arbitrary number of needles in different ranges across the boundary in the longitudinal direction of the needle beds disposed at least in a pair of front and rear sides, wherein symmetrical loops of the final course of both knit fabrics across the boundary are overlaid and knitted by binding off.

1 Claim, 9 Drawing Sheets

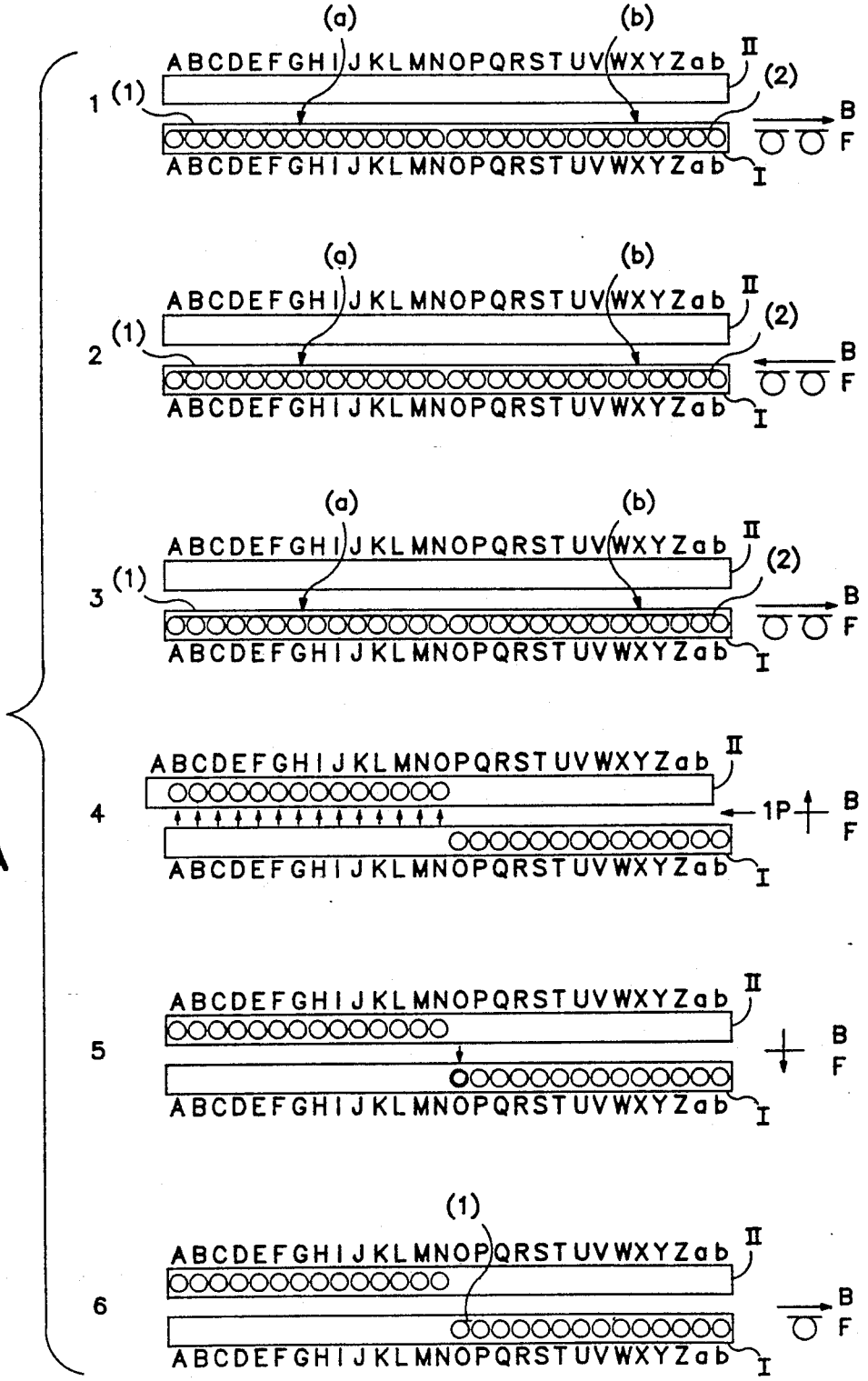
FIG. IA

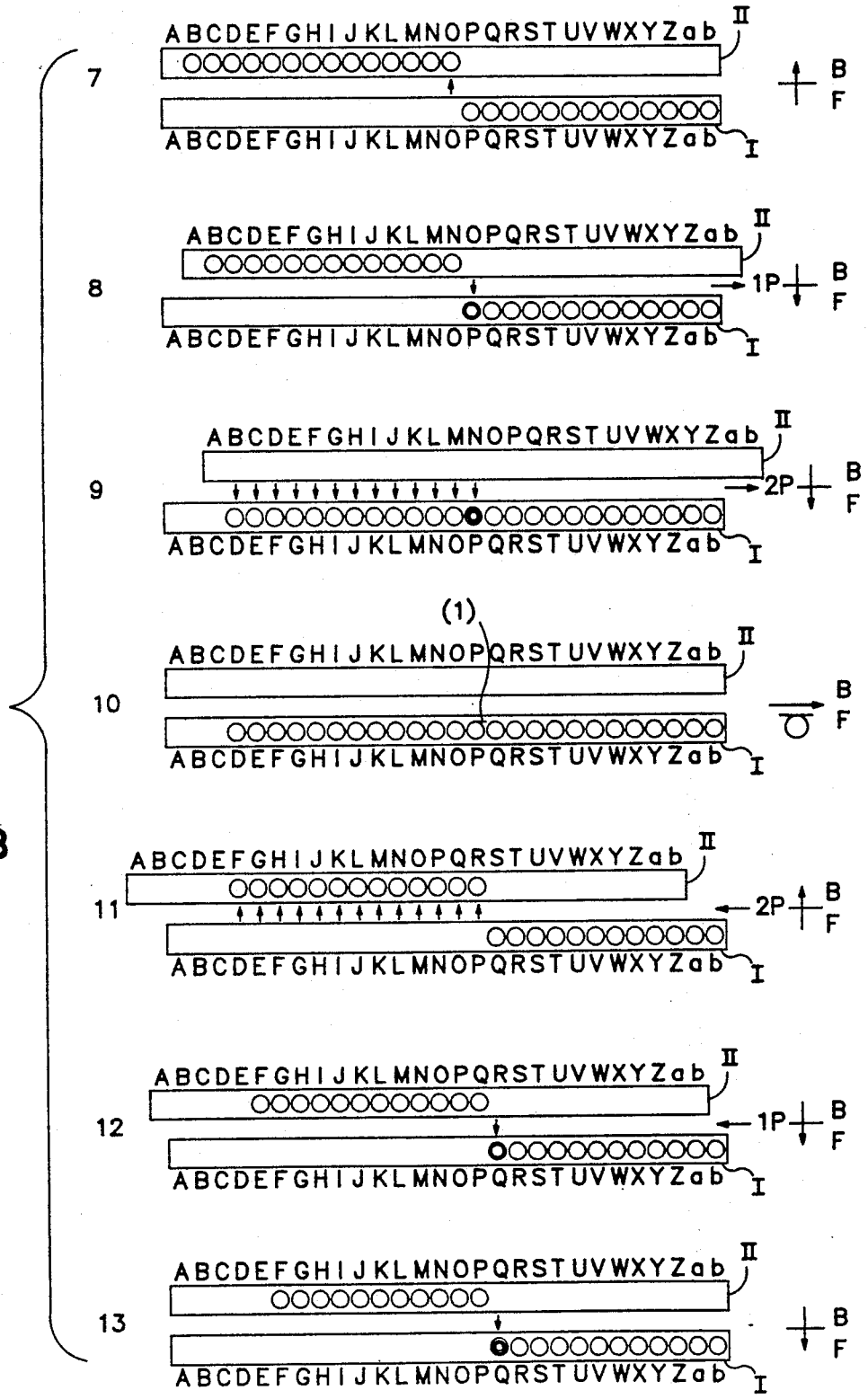
FIG. IB

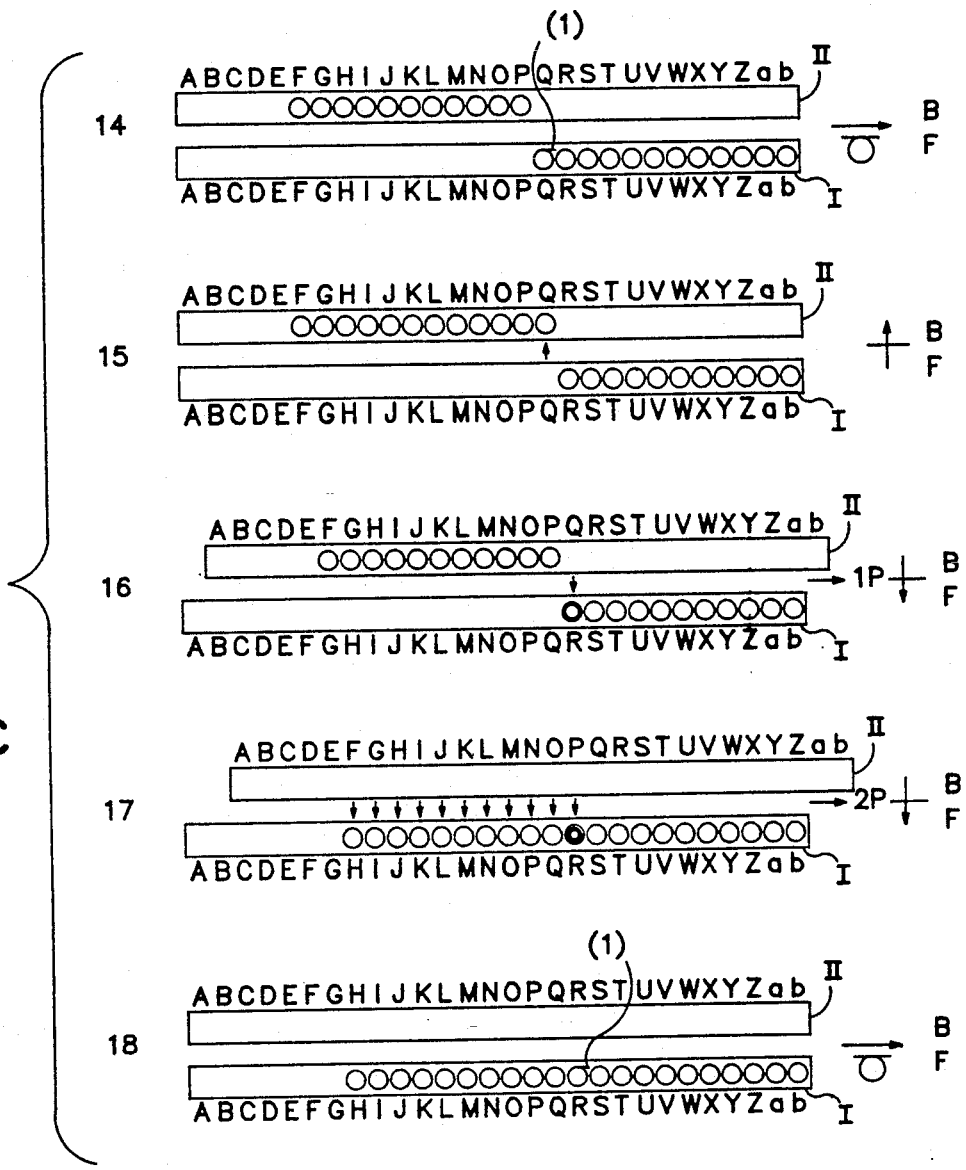
FIG. IC

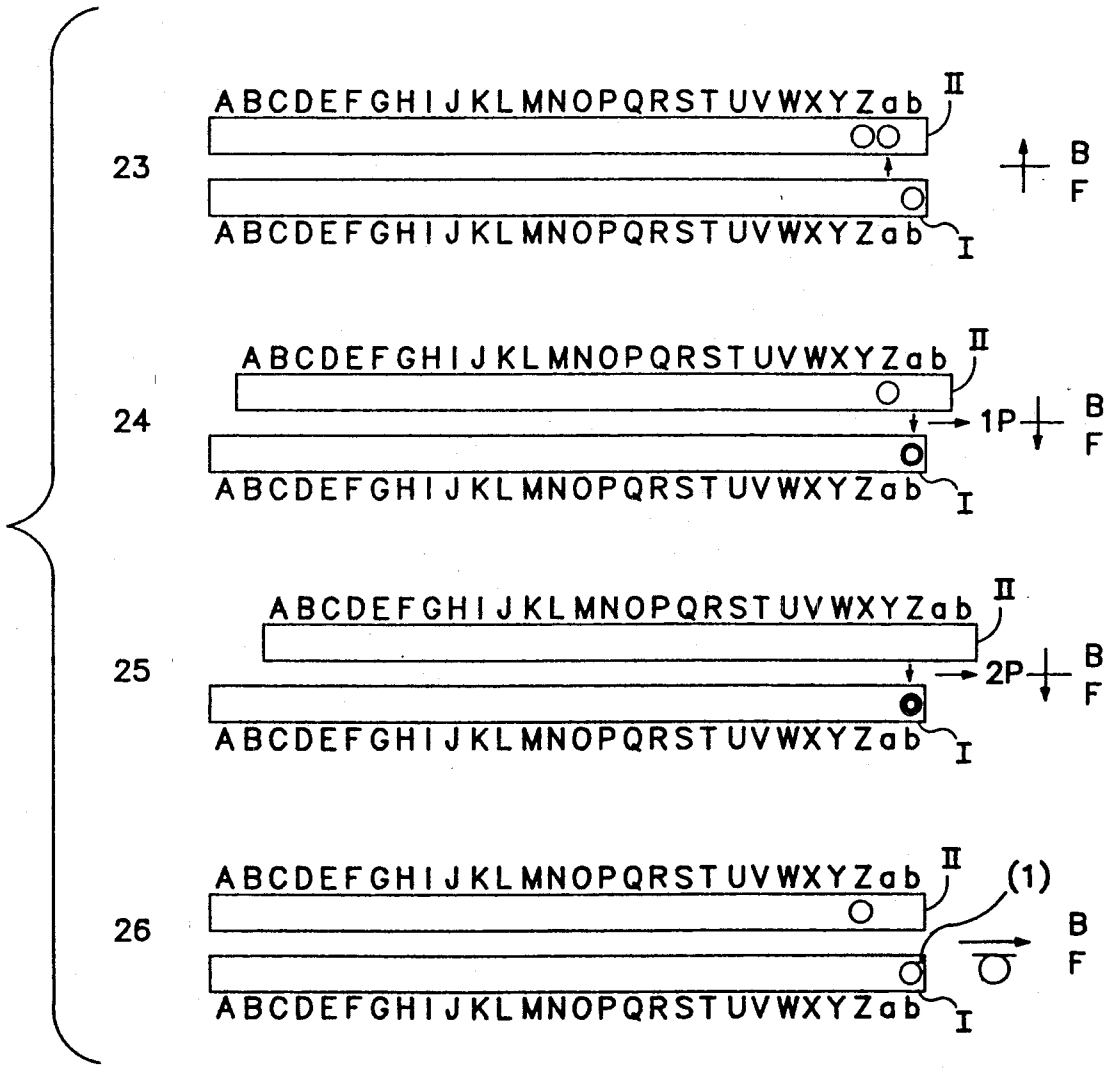
FIG. IE

FIG. IF
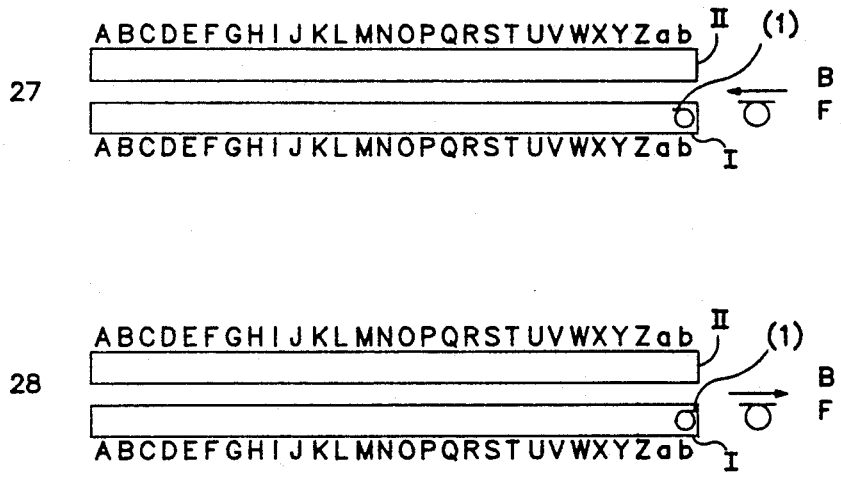
↑ TRANSFERRING OF A LOOP OF THE FORWARD FIXED NEEDLE BED TO A KNITTING NEEDLE OF THE REAR MOVING NEEDLE BED
↓ TRANSFERRING OF A LOOP OF THE REAR MOVING NEEDLE BED TO A KNITTING NEEDLE OF THE FORWARD FIXED NEEDLE BED
○ A LOOP
◎ DOUBLE LOOPS
◎ TRIPLE LOOPS
KNITTING OF A LOOP

CONNECTIVE KNITTING METHOD OF TAPE-SHAPED KNIT END AND TAPE-SHAPED KNIT FABRIC HAVING AN END PART LINKED IN A KNIT STATE

BACKGROUND OF THE INVENTION

The present invention relates to a knitting method and a knit fabric for linking a rope- or tape-shaped knit fabric in the collar of a sweater, neck rope portion of a tanktop, lower end portion of baseball stockings, a neck rope portion of an apron or the like.

For example, when forming a tape-shaped knit part in the collar portion of a sweater, in the first place, a knit fabric in a length corresponding to the peripheral edge of the collar is formed in a desired width and this tape- or rope-shaped knit fabric is sewn to the collar of the sweater by linking or other sewing means, and then the end portion of the tape- or rope-shaped knit fabric is joined by linking or other sewing means.

In the case of forming the tape-shaped rope part in the collar of the sweater as set forth above, the end portions of the rope are overlaid and joined and the thickness is increased in that portion, which is unfavorable not only for appearance but also for comfort of wearing.

Besides, sewing means such as linking is performed in a separate process from a knitting process, the productivity is impaired due to the extra sewing process, and the manufacturing cost is increased.

Furthermore, since sewing means, such as linking, is done manually, it tends to be irregular and the value of the product is lowered.

SUMMARY OF THE INVENTION

The invention is devised in the light of the above problems, and an object of the invention is to provide a connective knitting method of two tape-shaped knit pieces which is employed in a knitting procedure of a tape-shaped knit piece and a tape-shaped knit fabric knitted thereby. The method comprises steps of: knitting two tape-shaped knit pieces by a flat knitting machine possessing at least a pair of front and rear needle beds, either or both of which are composed movably in a longitudinal direction, the two tape-shaped knit pieces being positioned with a boundary between them in a longitudinal direction on either of the front and the rear needle beds; overlaying symmetrical loops of the final course of both the knit pieces across the boundary and binding off the overlaid symmetrical loops gradually; thus repeating the latter step by a proper number of times depending on the width of two tape-shaped knit pieces until the two pieces are connected by the knitting machine.

First of all, by means of a flat knitting machine possessing needle beds disposed at least in a pair of front and rear sides, with one or both thereof being composed to be movable in the lateral direction, two pieces of tape-shaped knit fabric are knitted in a specified length by arbitrary needles in different ranges across the boundary in the longitudinal direction of one of the needle beds.

In consequence, when two pieces of tape-shaped knit fabric knitted across the boundary reach a specified length, the loop portion of the final course of one of the knit fabrics is transferred to the needles of the other needle bed, which is the moving side knit fabric, the needle bed is moved so that the loop portion of the end part of the moving side knit fabric is overlaid on the loop of the end part of the part adjoining other fixed side knit fabric, and the loop of the moving side knit fabric of the overlaying part is transferred and overlaid on the loop of the fixed side knit fabric and a new loop is formed on this overlaid part.

Thus, a part of the loop of the moving side knit fabric and a part of the loop of the fixed side knit fabric are overlaid and a new loop is formed in that portion, so that one loop is decreased in the moving side knit fabric.

Next, this new loop, a part of the loop of the adjoining moving side knit fabric, and a part of the loop of the fixed side knit fabric are overlaid, and another loop of the fixed side knit fabric are overlaid, and another loop is formed on the overlaid portion, and thereby one more loop is decreased in the moving side fabric, and in addition to the decrease of one loop in the fixed side loop, two loops (three loops when starting bonding) are decreased in total.

By repeating this sequence of forming a new loop on an overlaid loop by a proper number of times depending on the width of the knit fabric, the end parts of both knit fabrics are joined and the final end portion of the junction is prevented from loosening the stitch.

BRIEF DESCRIPTION OF THE DRAWINGS

The drawings illustrate an embodiment of a connective knitting method of tape-shaped knit fabric and a connective knitting method having the end portions linked in a knitted state according to the invention, in which:

FIGS. 1A–1D are knitting diagrams in the principal courses until joining the end parts of the tape-shaped knit fabric disposed, for example, in the collar part of a sweater;

FIGS. 1E AND 1F illustrate knitting diagram in the courses for arranging the joined ends;

DESCRIPTION OF THE PREFERRED EMBODIMENT

Figure 1D:
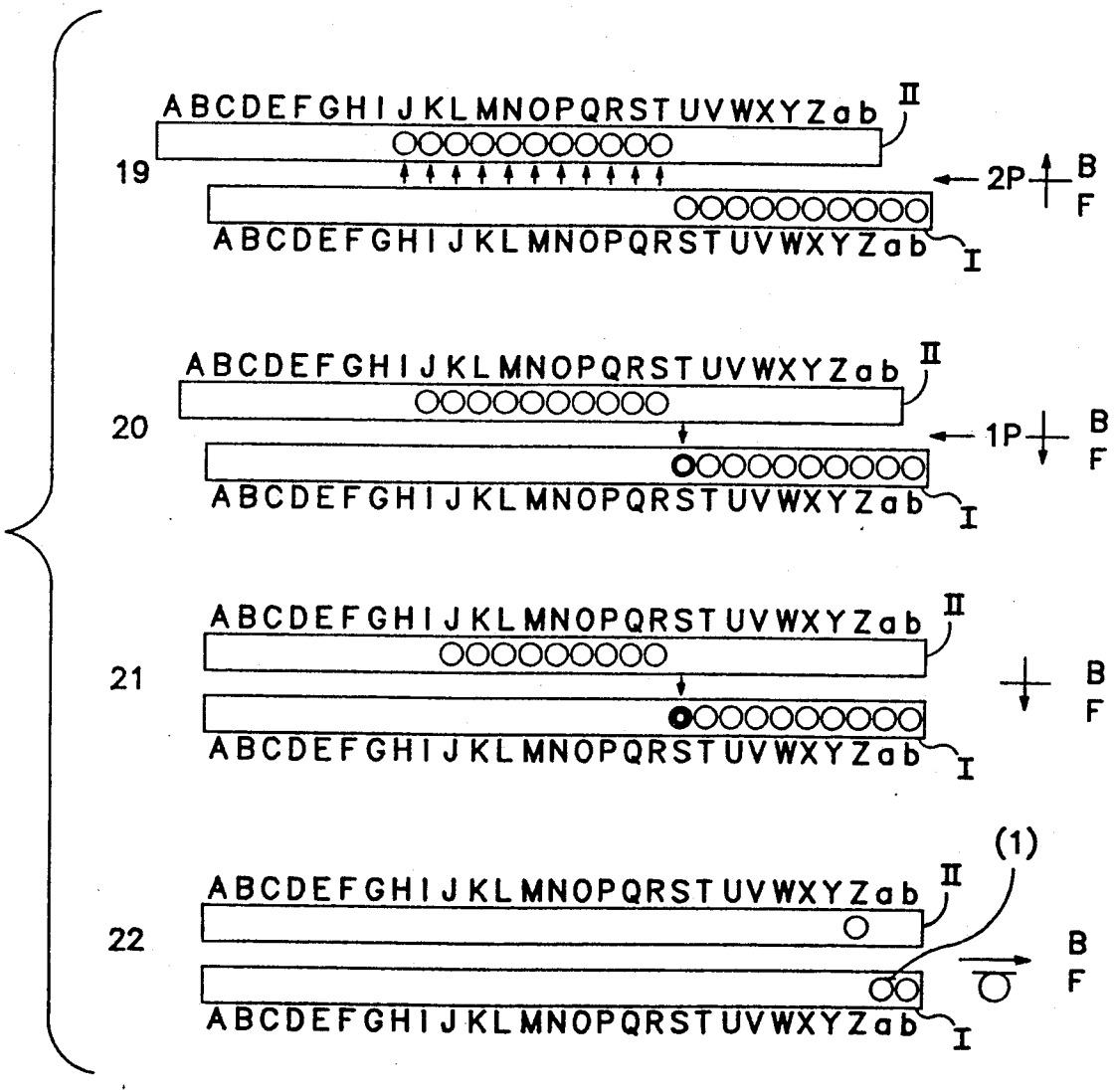

Referring now to the drawings, one of the embodiments of the invention is described in detail below.

The knitting machine used in this embodiment is a flat knitting machine, having multiple knitting needles disposed on needle beds laid out in a V-form in a side view in a manner free to move and slide back and forth, with the rear one of the needle beds formed movably in the lateral direction.

FIGS. 1A–1D are knitting diagrams in the principal courses until joining the end portions of the tape-shaped knit fabric disposed, for example, in the collar part of the sweater, in which the Roman numeral I denotes the forward fixed needle bed, and II is the rear movable needle bed, and the capital letters A, B, C, D, E, . . . represent the needles of the both needle beds I, II.

In the diagrams, blocks 1 and 3 are knitting courses of the tape-shaped knit pieces, one of which being a moving side knit piece (a) knitted by a knitting yarn (1) supplied from a carrier, which is out of the area of the drawing, into the knitting needles A to N among the knitting needles A, B, C, D, E, . . . , Y, Z, a, b of the fixed side knit piece (b) knitted by a knitting yarn (2) supplied from another carrier, which is out of the area of the drawing, into the knitting needles O to b. As the courses of the blocks 1 to 3 are repeated, two pieces of tape-shaped knit pieces are knitted with a boundary between the needle N and knitting needle O.

When both the moving side knit fabric (a) and fixed side knit fabric (b) are knitted to a specific length, in block 4, the rear moving needle bed II is moved (by racking) one pitch to the left in the drawing from the reference position of blocks 1 to 3, and the loop of the moving side knit fabric (a) knitted by knitting yarn (1) with knitting needles A to N is transferred to the knitting needles B to O of the moving needle bed II.

Afterwards, when the moving needle bed II is returned to the reference position, the loop stopped on the knitting needle O is confronted with the loop of the knitting needle O of the adjoining fixed needle bed I.

In block 5, the loop on the knitting needle O of the moving needle bed II is transferred to the loop of the knitting needle O of the fixed needle bed I and overlaid, and in block 6, the knitting yarn (I) is supplied to the two overlapped loops on the knitting needle O of the fixed needle bed I and a new loop is formed thereby knitting a bind-off.

At this time, the carrier for feeding the knitting yarn (I) which has moved to the right of the knitting needle O of the fixed needle bed I in block 3 moves to the left of the knitting needle O in block 4 and further, it moves to the right of the knitting needle O in block 5. Further, the carrier is returned to the left of the knitting needle O of the fixed needle bed I after block 5 before block 6, that is, what is called, "kick-back" is performed.

In block 7, the new loop formed on the knitting needle O of the fixed needle bed I in block 6 is transferred to the knitting needle O of the moving needle bed II.

In block 8, racking the moving needle bed II one pitch to the right from the reference position, the loop of the knitting needle O of the moving needle bed II is transferred to the knitting needle P of the fixed needle bed I.

In block 9, racking the moving needle bed II further to the right by one pitch (two pitches from the reference position), the loops of the knitting needle B to N of the moving needle bed II are transferred to the knitting needles D to P of the fixed needle bed I. As a result, three loops are stopped on the knitting needle N of the fixed needle bed I.

In block 10, the knitting yard (1) is supplied from the carrier to the three loops stopped on the knitting needle P of the fixed needle bed I, and a new loop is further formed. The carrier supplying the knit yarn 2 is out of the area of the drawing when it does not operate.

In block 11, after racking the moving needle bed II two pieces to the left of the reference position, the loops stopped on the knitting needles D to P of the fixed needle bed I in block 10 are transferred to the knitting needles F to R of the moving needle bed II.

In block 12, racking the moving needle bed II one pitch to the right from the state of block 11 (the position one pitch left of the reference position), the loop of the knitting needle R of the moving needle bed II and the loop of the knitting needle Q of the fixed needle bed I are overlaid, and the loop of the knitting needle R of the moving needle bed II is transferred to the knitting needle Q of the moving bed II.

In block 13, racking the moving needle bed II one pitch to the right from the state of block 12 (reference position), the loop of the knitting needle Q of the moving needle bed II and the loop of the knitting needle Q of the fixed needle bed I are overlaid, and the loop of the knitting needle Q of the moving needle bed II is transferred to the knitting needle Q of the fixed needle bed I, so that three loops are stopped on the knitting needle Q of the fixed needle bed I.

In block 14, the knitting yarn (1) is supplied from the carrier to the three loops stopped on the knitting needle Q of the fixed needle bed I, and a new loop is further formed.

In block 15, the new loop formed on the knitting needle Q of the fixed needle bed I in block 14 is transferred to the knitting needle Q of the moving needle bed II.

In block 16, racking the moving needle bed II one pitch to the right of the reference position of block 15, the loop of the knitting needle O of the moving needle bed II is transferred to the knitting needle R of the fixed needle bed I.

In block 17, racking the moving needle bed II further one pitch to the right of the position in block 16 (two pitched right of the reference position), the loop of the knitting needle P of the moving needle bed II is transferred to the knitting needle R of the fixed needle bed I, and thus three loops are stopped on the knitting needle R.

In block 18, the knitting yarn (1) is supplied from the carrier to the three loops stopped on the knitting needle R of the fixed needle bed I, and a new loop is further formed.

In block 19, racking moving needle bed II two pitches to the left of the reference position, the loops stopped on the knitting needles H to R of the fixed needle bed I in block 18 are transferred to the knitting needles J to T of the moving needle bed II.

In block 20, racking the moving needle bed II one pitch to the right of the state in block 19 (one pitch left of the reference position), the loop of the knitting needle T of the moving needle bed II and the loop of the knitting needle S of the fixed needle bed I are overlaid, and the loop of the knitting needle T of the moving needle bed II is transferred to the knitting needle S of the moving needle bed II.

In block 21, racking the moving needle bed II one pitch to the right of the state in block 20 (corresponding to the reference position), the loop of the knitting needle S of the moving needle bed II and the loop of the knitting needle S of the fixed needle bed I are overlaid, and the loop of the knitting needle S of the moving needle bed II is transferred to the knitting needle S of the fixed needle bed I, so that three loops are stopped on the knitting needle S of the fixed needle bed I. The knitting yarn (1) is supplied from the carrier to the three loops on the knitting needle S of the fixed needle bed I, and a new loop is further formed.

When the courses from block 14 to 21 are repeated in this way, the loops of the moving side fabric (a) and fixed side fabric (b) having been knitted in blocks 1 to 3 are gradually knitted in, to be bound off and dislocated from the knitting needles, and in block 22 the loops are gradually decreased until they are stopped only on the knitting needles a, b of the fixing needle bed I and knitting needle Z of the moving, needle bed II.

FIGS. 1E and 1F show the courses of terminating the joint ends, and in block 23 the loop of the knitting needle a of the fixed needle bed I is transferred to the knitting needle a of the moving needle bed II.

In block 24, racking the moving needle bed II one pitch to the right of the reference position in block 23, the loop of the knitting needle a of the moving needle bed II is transferred to the knitting needle b of the fixed needle bed I.

In block 25, racking the moving needle bed II one pitch further to the right of the state in block 24 (two pitches to the right of the reference position), and loop of the knitting needle Z of the moving needle bed II is transferred to the knitting needle b of the fixed needle bed I. As a result, three loops are stopped on the knitting needle b of the fixed needle bed I.

In block 26 the knitting yarn (1) is supplied from the carrier to the three loops stopped on the knitting needle b of the fixed needle bed I, and a new loop is formed.

The loop formed on the knitting needle b of the fixed needle bed I is locked so as not to unravel by repeating blocks 27 and 28 by a specified number of times, and is dislocated from the knitting needle b.

Figure 2:
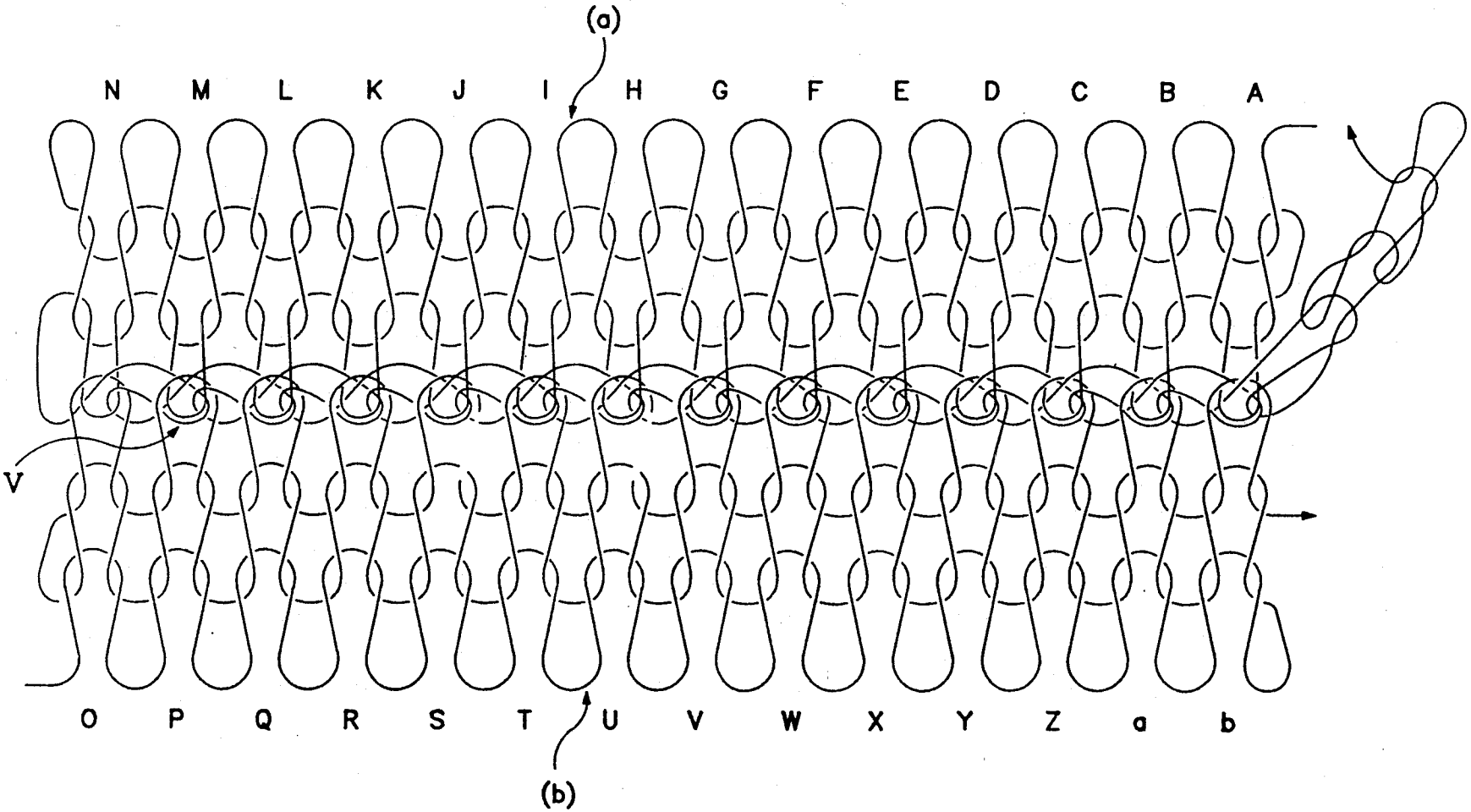
FIG. 2 is a plan view showing the end-to-end joined state of moving side knit fabric (a) and fixed side knit fabric (b)
Figure 3:
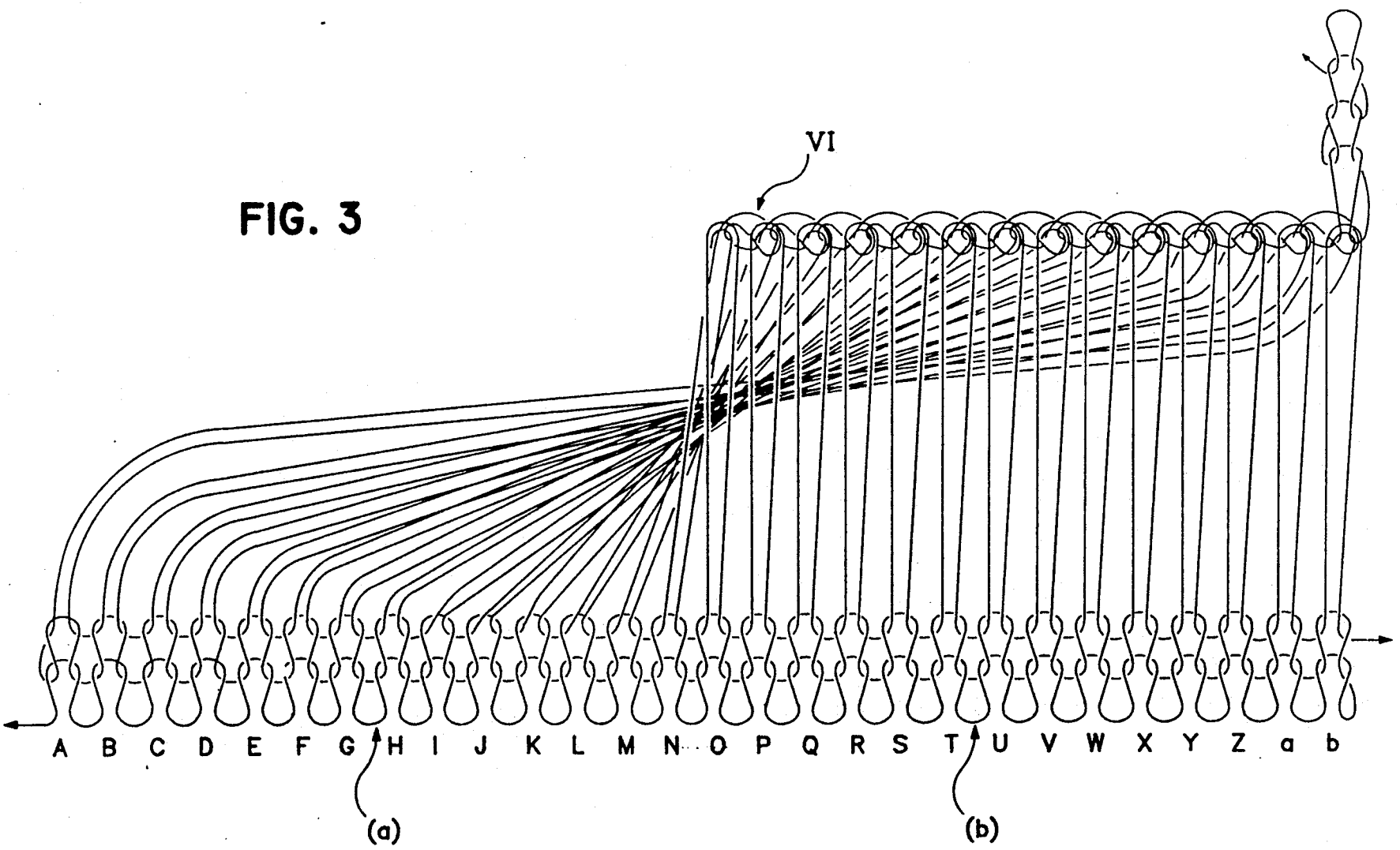
FIG. 3 is a developed diagram showing the end-to-end joined state of moving side knit fabric (a) and fixed side moving fabric (b)
Figure 4:
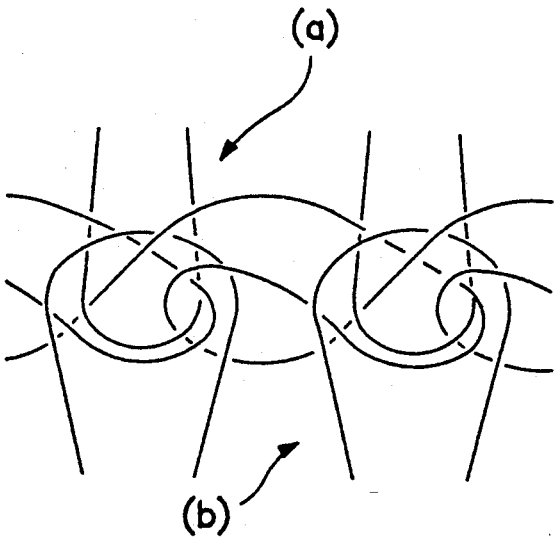
FIG. 4 is a magnified view of part V in FIG. 2.
Figure 5:
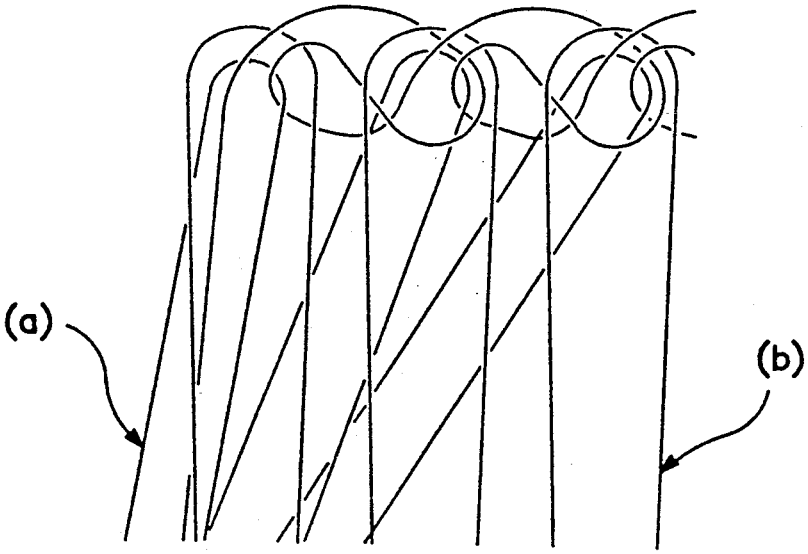
FIG. 5 is a magnified view of part V in FIG. 2.

Specifically according to the method of this invention the end extension portion of the left front body panel is knitted by the knitting needles A to N of the front needle bed and the end extension for the right front body panel is knitted by the knitting needles O to b of the front needle bed. The end portions of the moving side knit fabric (a) and fixed side knit fabric (b) formed through these courses is joined by stitching one-by-one as if each loop were knitted in spontaneously as shown in FIGS. 2 to 5.

In the foregoing embodiment, the flat knitting machine is composed of multiple knitting needles disposed on a pair of needle beds confronting each other back and forth, but the invention may be also realized if two pairs or more of needle beds are provided.

In the illustrated example, the rear needle bed is movable, but, needless to say, the invention may be realized if the front needle bed only is movable or both needle beds are movable.

Furthermore, the matrix texture of the belt-shaped knit fabric may be plain knitting, rib knitting, tubular knitting or any other.

In addition, the invention may be realized in the neck rope part of a tanktop, a lower end portion of baseball stockings, a neck rope part of an apron, and other parts linking the tape- or rope-shaped portions.

The two pieces of knit fabric are knitted together and the transfers are carried out by a controlled computer following a designed knitting pattern.

What is claimed is:

1. A knitting method of connecting two tape-shaped knit pieces which is employed in a knitting procedure of a tape-shaped knit fabric comprising the steps of:

a) knitting two tape-shaped knit pieces by a flat knitting machine possessing at least front and rear needle beds, said needle beds being movably composed in a longitudinal direction, the two tape-shaped knit pieces knitted on either of the front and the rear needle beds with a boundary therebetween in a longitudinal direction;

b) transferring one of the two tape-shaped knit pieces positioned on one needle bed to the other needle bed;

c) transferring a loop of the tape-shaped knit pieces adjoining the boundary onto a loop of the non-transfered tape-shaped knit piece adjoining the boundary;

d) feeding a yarn from a carrier to the two loops to form a new loop and to bind off the two loops;

e) transferring the new loop and a loop of the tape-shaped knit piece adjoining the boundary onto a loop of the non-transferred tape-shaped knit piece adjoining the boundary;

f) feeding a yarn from a carrier to the three loops to form a new loop and to bind off the three loops; and g) repeating steps e) and f) by a predetermined number of times depending on a width of the two tape-shaped knit pieces until the two pieces are connected.

* * * * *